US010001745B2

(12) United States Patent
Itabashi

(10) Patent No.: US 10,001,745 B2
(45) Date of Patent: Jun. 19, 2018

(54) DEVELOPING CARTRIDGE HAVING SHAFT, GEAR, TUBULAR MEMBER, AND RELAY MEMBER

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/466,095

(22) Filed: Mar. 22, 2017

(65) Prior Publication Data

US 2018/0095410 A1 Apr. 5, 2018

(30) Foreign Application Priority Data

Sep. 30, 2016 (JP) ..... 2016-193866
Dec. 28, 2016 (JP) ..... 2016-254812

(51) Int. Cl.
*G03G 21/16* (2006.01)
*G03G 21/18* (2006.01)
*G03G 15/08* (2006.01)

(52) U.S. Cl.
CPC ..... *G03G 21/1647* (2013.01); *G03G 21/1857* (2013.01); *G03G 15/0865* (2013.01)

(58) Field of Classification Search
CPC ..... G03G 21/1647; G03G 21/1857; G03G 15/0865
See application file for complete search history.

(56) References Cited

U.S. PATENT DOCUMENTS

2013/0051833 A1 2/2013 Itabashi et al.
2015/0160608 A1* 6/2015 Sawashima ..... G03G 21/186 399/167
2015/0212475 A1* 7/2015 Ueno ..... G03G 15/757 399/167

(Continued)

FOREIGN PATENT DOCUMENTS

JP 2009-244563 A 10/2009
JP 2013-011911 A 1/2013
JP 2013-54056 A 3/2013

OTHER PUBLICATIONS

International Search Report and Written Opinion issued in related international application PCT/JP2017/01172, dated May 16, 2017.

*Primary Examiner* — Rodney Bonnette
(74) *Attorney, Agent, or Firm* — Merchant & Gould P.C.

(57) ABSTRACT

In a developing cartridge, a tubular member is rotatable about an axis. The tubular member includes a protrusion extending along a portion of a peripheral surface of a shaft. The relay member is positioned between a gear and the tubular member. The relay member is movable in an axial direction of the shaft during rotation of the gear from a first rotational position to a second rotational position. In a case where the gear is at the first rotational position, the gear and the relay member engage with each other and the relay member and the tubular member engage with each other to rotate the tubular member. In a case where the gear is at the second rotational position, the engagement between the gear and the relay member or the engagement between the relay member and the tubular member is released.

10 Claims, 12 Drawing Sheets

(56) References Cited

U.S. PATENT DOCUMENTS

2015/0248100 A1* 9/2015 Hayakawa ..... G03G 15/757
399/167
2016/0370757 A1* 12/2016 Sato ..... G03G 21/1647

* cited by examiner

DEVELOPING CARTRIDGE HAVING SHAFT, GEAR, TUBULAR MEMBER, AND RELAY MEMBER

CROSS REFERENCE TO RELATED APPLICATION

This application claims priorities from Japanese Patent Application No. 2016-193866 filed Sep. 30, 2016 and Japanese Patent Application No. 2016-254812 filed Dec. 28, 2016. The entire contents of the priority applications are incorporated herein by reference.

TECHNICAL FIELD

The present disclosure relates to a developing cartridge.

BACKGROUND

A developing cartridge including a developing roller is known in the art. The developing cartridge is attachable to and detachable from an image forming apparatus.

There is known a developing cartridge including a gear rotatable from a first position to a second position, and a protrusion provided at the gear. The protrusion is movable along with the rotation of the gear, and is configured to be in contact with a lever provided in an image forming apparatus. The lever is moved by the abutment with the protrusion. The image forming apparatus detects the movement of the lever to determine a specification of the developing cartridge. Further, the gear includes a toothless portion. In a state where the toothless portion is brought into facing with a drive gear configured to transmit driving force to the gear, meshing engagement between the gear and the drive gear is released to stop rotation of the gear. Thus, movement of the protrusion is also stopped.

SUMMARY

In such a conventional developing cartridge, demand has been made for stopping movement of the protrusion by a structure other than the above described structure using disengagement between the gear and the drive gear.

It is therefore an object of the disclosure to provide a developing cartridge capable of stopping movement of the protrusion with a structure other than the structure where the movement of the protrusion is stopped by the disengagement between the gear and the drive gear.

According to one aspect, the disclosure provides a developing cartridge. The developing cartridge includes a casing, a shaft, a tubular member, and a relay member. The casing is configured to accommodate therein developing agent, and the casing having an outer surface. The shaft is positioned at the outer surface. The shaft extends in an axial direction, and the shaft includes a peripheral surface. The gear is rotatable about a first axis extending in the axial direction from a first rotational position to a second rotational position. The tubular member is rotatable about an axis extending in the axial direction. The tubular member extends in the axial direction. The tubular member includes a protrusion rotatable with the tubular member, the protrusion extending along a portion of the peripheral surface of the shaft. The relay member is positioned between the gear and the tubular member in the axial direction. The relay member is movable in the axial direction during rotation of the gear from the first rotational position to the second rotational position. In a case where the gear is at the first rotational position, the tubular member is rotatable with the relay member and the gear in a state where the gear and the relay member engage with each other and the relay member and the tubular member engage with each other. In a case where the gear is at the second rotational position, an engagement between the gear and the relay member or an engagement between the relay member and the tubular member is released.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge 1 according to one embodiment will be described with reference to FIGS. 1 through 7B.

1. Outline of Developing Cartridge

A developing cartridge 1 is configured to accommodate therein developing agent. The developing cartridge 1 includes a developing roller 2, a casing 3 and a coupling 4.

1.1 Developing Roller 2

Figure 2:
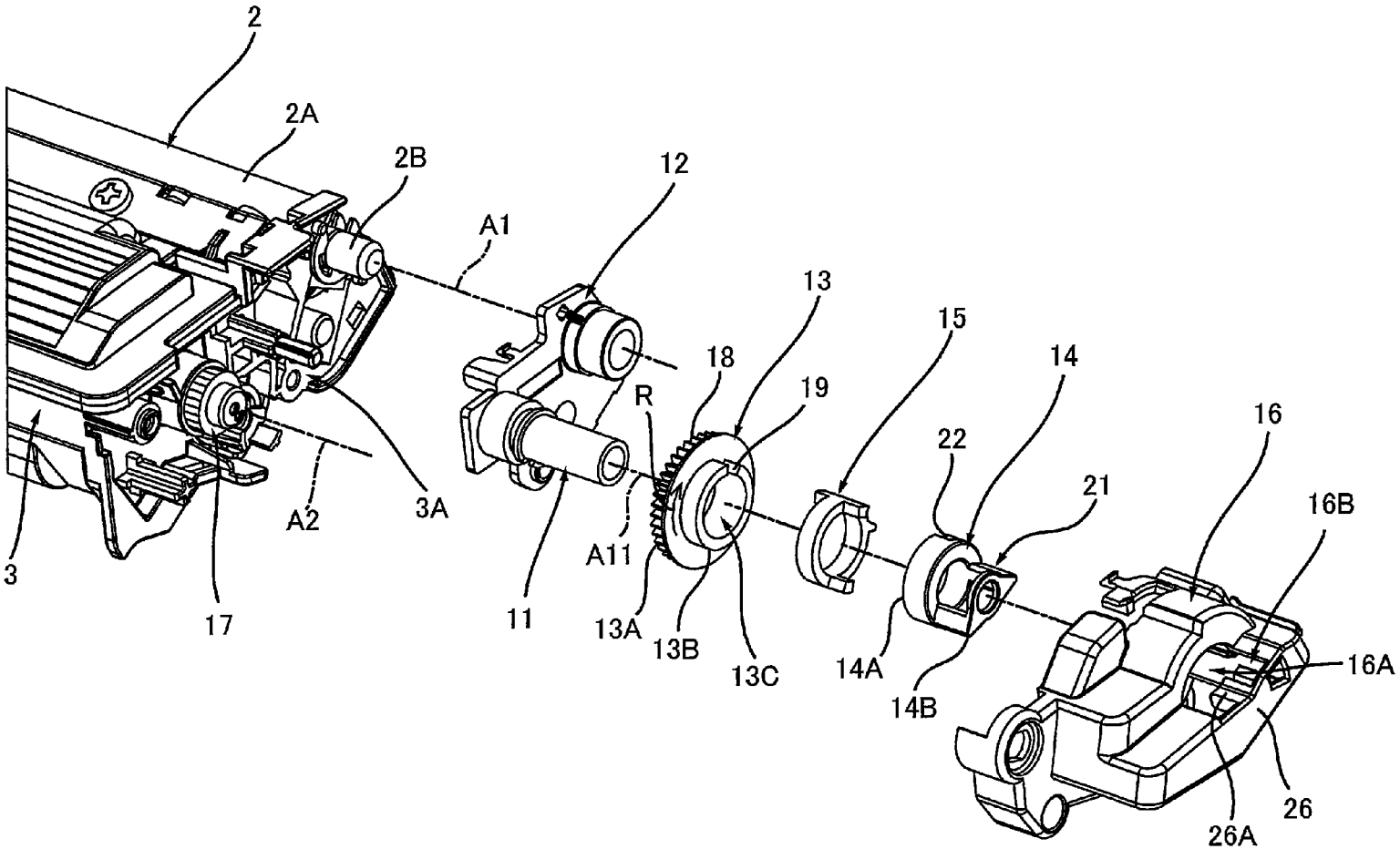
FIG. 2 is an exploded perspective view of the developing cartridge according to the embodiment.

The developing roller 2 is rotatable about a developing roller axis A1 extending in an axial direction of the developing roller 2. A portion of an outer peripheral surface of the developing roller 2 is exposed to an outside of the casing 3. The developing roller 2 includes a roller body 2A and a developing roller shaft 2B (FIG. 2). The roller body 2A extends in the axial direction and is made from an electrically conductive rubber. The developing roller shaft 2B extends in the axial direction, that is, extends along the developing roller axis A1. The developing roller shaft 2B is made from metal.

1.2 Casing 3

The casing 3 is configured to accommodate therein developing agent such as toner. In the following description, "inside" of the casing 3 implies a side at which the developing agent is accommodated, and "outside" of the casing 3 implies a side opposite to the inside. The casing 3 extends in the axial direction, and has one outer surface 3A and another outer surface 3B spaced away from the one outer surface 3A in the axial direction.

Incidentally, an agitator (not illustrated) is provided inside the casing 3. The agitator is configured to agitate developing agent accumulated in the casing 3 and to supply the developing agent to the developing roller 2. The agitator is rotatable about an agitator axis A2 (FIG. 2) extending in the axial direction. The agitator includes an agitator shaft and a blade extending therefrom. The agitator shaft extends in the axial direction along the agitator axis A2.

1.3 Coupling 4

The coupling 4 is configured to receive driving force, and is positioned at the other outer surface 3B. The coupling 4 is positioned opposite to a gear 13 (FIG. 2, described later) in the axial direction with respect to the casing 3. The coupling 4 is rotatable about a coupling axis A3 extending in the axial direction. The driving force received in the coupling 4 is transmitted to the developing roller shaft 2B and the agitator shaft.

2. Details of Developing Cartridge 1

Details of the developing cartridge 1 will be described with reference to FIGS. 2 through 5B. As illustrated in FIG. 2, the developing cartridge 1 further includes the gear 13, a tubular member 14, and a relay member 15. The tubular member 14 is spaced away from the gear 13 in the axial direction. The relay member 15 is positioned between the gear 13 and the tubular member 14 in the axial direction. As illustrated in FIGS. 4A and 6A, the relay member 15 is moveable in the axial direction from a first position (FIG. 4A) to a second position (FIG. 6A). The relay member 15 engages with the gear 13 and the tubular member 14 in a state where the relay member 15 is at the first position. Therefore, the gear 13, the relay member 15 and the tubular member 14 are rotatable altogether. In other words, in a state where the relay member 15 is at the first position, the tubular member 14 is rotated along with the gear 13 upon rotation of the gear 13.

Then, the relay member 15 is positioned at a second position as a result of rotation of the gear 13 to a predetermined rotational position. More specifically, as a result of rotation of the gear 13 from the first rotational position (FIG. 4A) to the second rotational position (FIG. 6A), the relay member 15 is brought to the second position. The engagement between the gear 13 and the relay member 15 is released in a state where the relay member 15 moves to the second position. Therefore, rotation of the relay member 15 and the tubular member 14 is stopped. Detailed structure of the developing cartridge 1 will be described below.

The developing cartridge 1 further includes a shaft 11, a bearing 12, a gear cover 16, and an agitator gear 17.

2.1 Shaft 11

The shaft 11 is positioned opposite to the coupling 4 (FIG. 1) in the axial direction with respect to the casing 3. The shaft 11 extends in the axial direction, that is, along a first axis A11 extending in the axial direction. The shaft 11 extends from the bearing 12, and is hollow cylindrical. The shaft 11 is positioned at the one outer surface 3A of the casing 3 as a result of attachment of the bearing 12 to the one outer surface 3A. The shaft 11 is made from an electrically conductive resin. In the following description, the terms "electrically conductive" implies electro-conductivity capable of supplying developing bias to the developing roller shaft 2B. Polyacetal resin (POM) is one example of the electrically conductive resin.

Figure 3A:
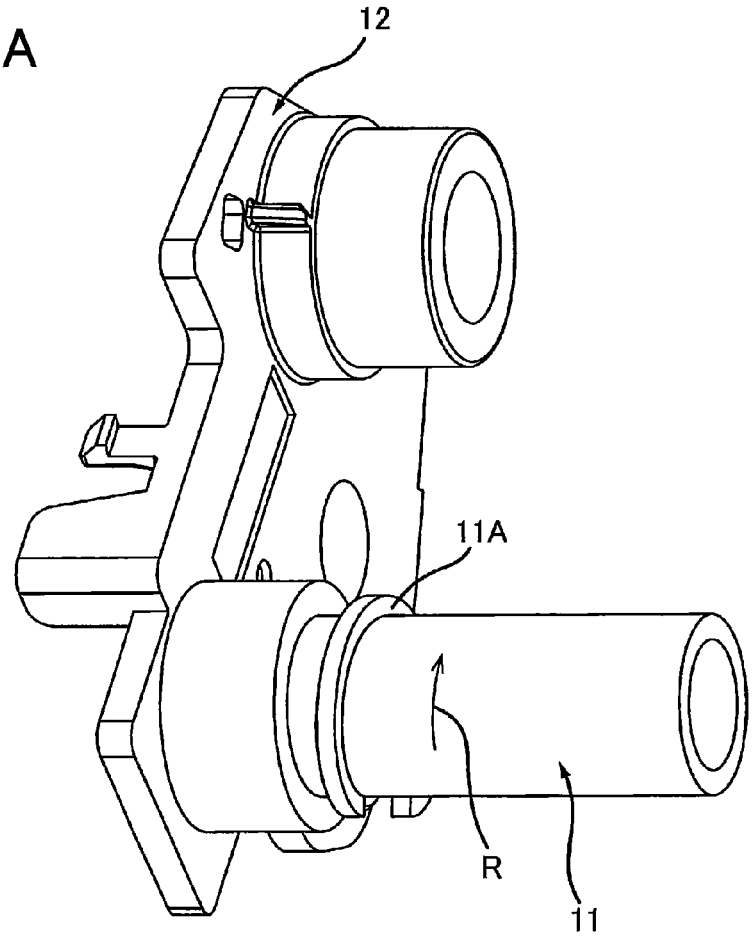
FIG. 3A is a perspective view of a bearing in the developing cartridge according to the embodiment.
Figure 4A:
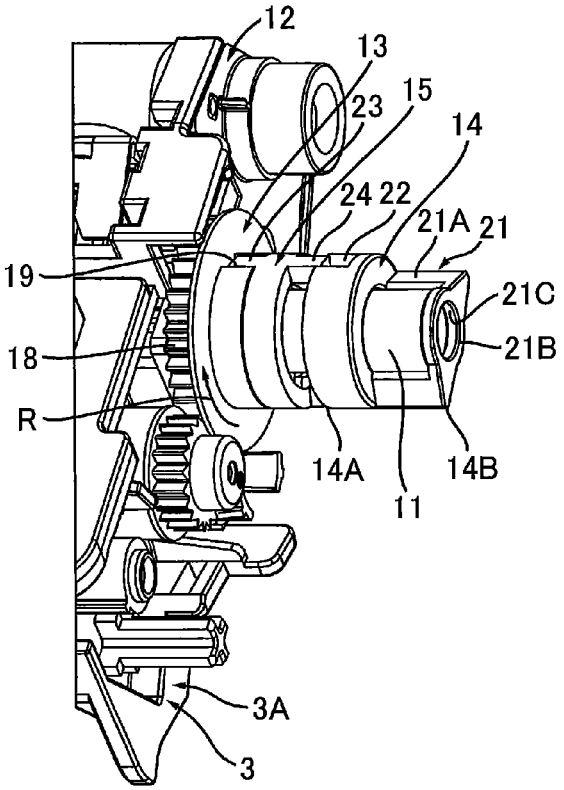
FIG. 4A is a partial perspective view of the developing cartridge according to the embodiment for description of movement of the relay member, and illustrating a state in which a gear is at its first rotational position and the relay member is at its first position.

As illustrated in FIG. 3A, the shaft 11 has a rib 11A. The rib 11A protrudes from a peripheral surface of the shaft 11. The rib 11A is helical in shape. More specifically, the rib 11A extends in a rotational direction R of the gear 13 and in the axial direction.

2.2 Bearing 12

As illustrated in FIG. 2, the bearing 12 is positioned at the one outer surface 3A. The developing roller shaft 2B is rotatably fitted with the bearing 12. Thus, the bearing 12 supports the developing roller shaft 2B. The bearing 12 is made from electrically conductive resin. The bearing 12 covers a peripheral surface of the developing roller shaft 2B, and in contact with the peripheral surface. Therefore, the developing roller shaft 2B is electrically connected to the bearing 12. Further, the shaft 11 is electrically connected to the developing roller 2 through the bearing 12, because the shaft 11 extends from the bearing 12.

2.3 Gear 13

As illustrated in FIG. 2, the gear 13 is positioned at the one outer surface 3A. More specifically, the gear 13 is positioned opposite to the one outer surface 3A with respect to the bearing 12 in the axial direction. The gear 13 has a through-hole 13C. The shaft 11 is inserted through the through-hole 13C, so that the gear 13 is rotatable about the shaft 11. Thus, the gear 13 is rotatable about the first axis A11 extending in the axial direction from the first rotational position to the second rotational position. The gear 13 has one end portion 13A and another end portion 13B in the axial direction. The other end portion 13B is positioned farther from the one outer surface 3A than the one end portion 13A is from the one outer surface 3A in the axial direction. The gear 13 includes a plurality of gear teeth 18 and includes a first recessed portion 19.

The plurality of gear teeth 18 are positioned at the one end portion 13A of the gear 13, and are positioned at a peripheral surface of the gear 13. More specifically, the plurality of gear teeth 18 are provided at an entire peripheral surface of the gear 13 in the rotational direction R of the gear 13. The plurality of gear teeth 18 are arrayed in the rotational direction R.

The first recessed portion 19 is positioned at the other end portion 13B. The first recessed portion 19 is recessed from an end surface of the other end portion 13B toward the one end portion 13A in the axial direction. A first rib 23 (described later) is engageable with the first recessed portion 19.

2.4 Tubular Member 14

As illustrated in FIG. 2, the tubular member 14 is positioned opposite to the one outer surface 3A with respect to the gear 13 in the axial direction.

The tubular member 14 extends in the axial direction, and has one end portion 14A and another end portion 14B in the axial direction. The other end portion 14B is positioned farther from the one outer surface 3A than the one end portion 14A is from the one outer surface 3A. The tubular member 14 is hollow cylindrical. Incidentally, the shape of the tubular member 14 is not limited to hollow cylinder, but any shape is available as long as the tubular member 14 is rotatable about the shaft 11. For example, the tubular member 14 may have a hollow prismatic columnar shape having a cylindrical bore. Further, a length in the axial direction of the tubular member 14 is not a significant factor. For example, the tubular member 14 may be ring shaped. Further, a portion of the surface portion of the tubular member 14 with respect to the rotational direction R of the gear 13 may be notched. The tubular member 14 is made from electrically insulative resin. The term "insulative" implies the insulating property capable of insulating developing bias. As illustrated in FIG. 4A, the tubular member 14 covers the peripheral surface of the shaft 11. In other words, the shaft 11 is inserted through the tubular member 14. Accordingly, the tubular member 14 is rotatable about an axis extending in the axial direction. More specifically, the tubular member 14 is rotatable about the shaft 11. Further, the tubular member 14 is movable in the axial direction relative to the shaft 11. The tubular member 14 includes a protrusion 21, and includes a second recessed portion 22. Further, the tubular member 14 includes another recessed portion (not illustrated).

The protrusion 21 is positioned at the other end portion 14B, and protrudes in the axial direction. The protrusion 21 is movable about the shaft 11 along with the rotation of the tubular member 14. Further, the protrusion 21 includes a first cover portion 21A and a second cover portion 21B.

The first cover portion 21A is configured to cover a portion of the peripheral surface of the shaft 11 with respect to the rotational direction R of the gear 13. More specifically, the first cover portion 21A extends in the axial direction. The first cover portion 21A also extends along the part of the peripheral surface of the shaft 11 with respect to the rotational direction R of the shaft 11. That is, the protrusion 21 extends along the portion of the peripheral surface of the shaft 11 in the rotational direction R of the shaft 11.

Incidentally, the first cover portion 21A is configured to move a component in the image forming apparatus in a state where the developing cartridge 1 is attached to the image forming apparatus. A lever is an example of the component in the image forming apparatus. The image forming apparatus further includes an optical sensor (not illustrated) configured to detect displacement of the lever. A sensor unit including a light emitting portion and a light receiving portion is used as the optical sensor. The lever includes an electrode. The electrode is configured to be in contact with the shaft 11 in a state where the developing cartridge 1 is attached to the image forming apparatus. The tubular member 14 functions as a cam for moving the lever in the image forming apparatus by the first cover portion 21A. More specifically, the tubular member 14 functions as the cam for moving the lever in the image forming apparatus by the first cover portion 21A while the tubular member 14 is rotated about the shaft 11 in a state where the developing cartridge 1 is attached to the image forming apparatus.

Figure 4B:
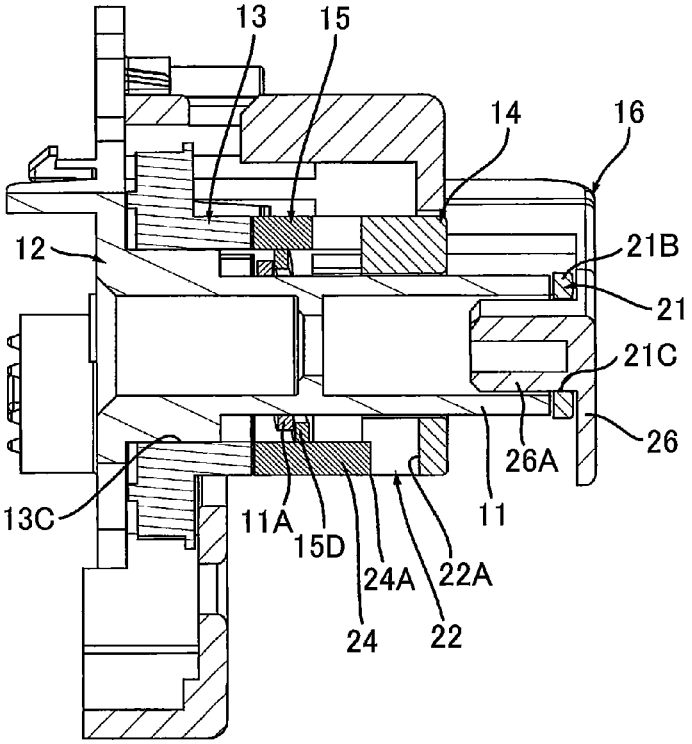
FIG. 4B is a cross-sectional view of FIG. 4A taken along a plane containing a first axis.

The second cover portion 21B is configured to cover a tip end of the shaft 11 in the axial direction. The second cover portion 21B is positioned at a tip end of the protrusion 21. The second cover portion 21B protrudes in a radial direction of the shaft 11. As illustrated in FIG. 4B, the second cover portion 21B is positioned between the shaft 11 and the gear cover 16.

More specifically, the second cover portion 21B is positioned between the tip end of the shaft 11 and a side cover 26 of the gear cover 16 (described later). With this structure, movement of the tubular member 14 toward the one outer surface 3A is prevented by the abutment of the second cover portion 21B with the tip end of the shaft 11 in a case where the tubular member 14 moves in the axial direction toward the one outer surface 3A. Further, movement of the tubular member 14 away from the one outer surface 3A in the axial direction is prevented by the abutment of the second cover portion 21B with the side cover 26 of the gear cover 16 in a case where the tubular member 14 moves away from the one outer surface 3A in the axial direction. Incidentally, the second cover portion 21B has a through-hole 21C. A protrusion 26A (described later) of the gear cover 16 is inserted through the through-hole 21C.

As illustrated in FIG. 4A, the second recessed portion 22 is positioned at the one end portion 14A of the tubular member 14. The second recessed portion 22 is recessed from one end of the one end portion 14A toward the other end portion 14B in the axial direction. A second rib 24 (described later) is engageable with the second recessed portion 22. Further, the tubular member 14 includes an additional recessed portion (not illustrated). A third rib 28 (described later) is engageable with the additional recessed portion.

2.5 Relay Member 15

As illustrated in FIGS. 4A and 6A, the relay member 15 is positioned between the gear 13 and the tubular member 14 in the axial direction. The relay member 15 is movable in the axial direction during rotation of the gear 13 from the first rotational position to the second rotational position. More specifically, the relay member 15 is moved in the axial direction away from the gear 13 during rotation of the gear 13 from the first rotational position to the second rotational position. In other words, the relay member 15 moves toward the tubular member 14 in the axial direction during rotation of the gear 13 from the first rotational position to the second rotational position.

Figure 3B:
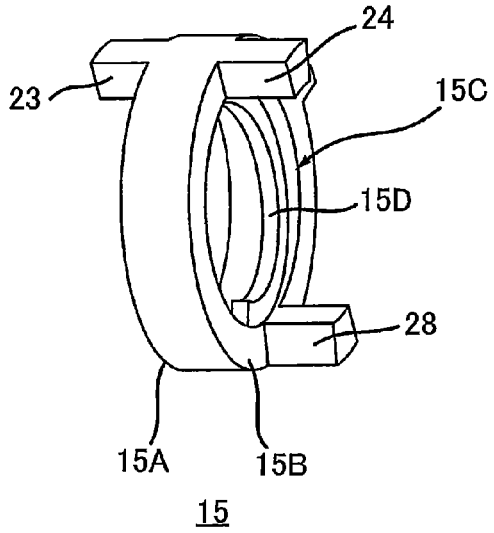
FIG. 3B is a perspective view of a relay member in the developing cartridge according to the embodiment.

As illustrated in FIG. 3B, the relay member 15 has a tubular shape extending in the axial direction. The relay member 15 has one end portion 15A and another end portion 15B in the axial direction. The other end portion 15B is positioned farther from the one outer surface 3A (FIG. 2) than the one end portion 15A is from the one outer surface 3A in the axial direction. The relay member 15 has a hole 15C which is a through-hole into which the shaft 11 (FIG. 2) is inserted. The hole 15C has an inner peripheral surface having helical shape. More specifically, a rib 15D is positioned at the inner peripheral surface of the hole 15C. The rib 15D is a helical rib for moving the relay member 15 in the axial direction along the helical shape of the rib 11A of the shaft 11. More specifically, the rib 15D protrudes radially inside of the hole 15C from the inner peripheral surface of the hole 15C, and extends in helical fashion. In other words, the rib 15D extends in the rotational direction R of the gear 13, and also extends in the axial direction. As illustrated in FIG. 4B, the rib 15D is in contact with the rib 11A in a state where the gear 13 is at the first rotational position and the relay member 15 is at the first position. Accordingly, the relay member 15 moves in the axial direction away from the gear 13 by the sliding contact of the rib 15D with the rib 11A in a state where the relay member 15 rotates about the shaft 11. That is, the relay member 15 is movable in the axial direction while rotating about the shaft 11 along the helical configuration of the rib 15D.

2.5(1) First Rib and Second Rib

As illustrated in FIG. 3B, the relay member 15 includes a first rib 23, a second rib 24, and a third rib 28.

The first rib 23 protrudes in the axial direction toward the gear 13 from an end surface of the one end portion 15A of the relay member 15. As illustrated in FIG. 4A, the first rib 23 is positioned in the first recessed portion 19 in a state where the gear 13 is at the first rotational position and the relay member 15 is at the first position. Thus, the first rib 23 engages with the first recessed portion 19 in a state where the gear 13 is at the first rotational position and the relay member 15 is at the first position. The relay member 15 is rotatable along with the gear 13 while the first rib 23 engages with the first recessed portion 19. Further, as illustrated in FIG. 6A, the first rib 23 is outside from and disengaged from the first recessed portion 19 in a state where the gear 13 is at the second rotational position and the relay member 15 is at the second position. That is, engagement between the gear 13 and the relay member 15 is released in a state where the gear 13 is at the second rotational position. More specifically, engagement between the first rib 23 and the first recessed portion 19 is released in a state where the gear 13 is at the second rotational position. The relay member 15 is stopped upon disengagement between the first rib 23 and the first recessed portion 19. Thus, movement of the tubular member 14 is stopped.

The second rib 24 will next be described. The second rib 24 protrudes in the axial direction toward the tubular member 14 from an end surface of the other end portion 15B of the relay member 15. As illustrated in FIG. 4A, the second rib 24 is positioned in the second recessed portion 22 in a state where the gear 13 is at the first rotational position and the relay member 15 is at the first position. Thus, the second rib 24 is engaged with the second recessed portion 22 in a state where the gear 13 is at the first rotational position and the relay member 15 is at the first position. More specifically, as illustrated in FIG. 4B, a distal end 24A of the second rib 24 is positioned in the second recessed portion 22 in a state where the gear 13 is at the first rotational position and the relay member 15 is at the first position. In this instance, the free end 24A of the second rib 24 is spaced away from an inner surface 22A of the second recessed portion 22 in the axial direction. The tubular member 14 is rotatable along with the relay member 15 while the second rib 24 engages with the second recessed portion 22. Therefore, the tubular member 14 is rotatable along with the relay member 15 and the gear 13 in a state where the gear 13 is at the first rotational position, while the gear 13 engages with the relay member 15, and the relay member 15 engages with the tubular member 14.

More specifically, the tubular member 14 is rotatable along with the relay member 15 and the gear 13 in a state where the gear 13 is at the first rotational position, while the first rib 23 engages with the first recessed portion 19 and the first rib 23 engages with the first recessed portion 19 and the second rib 24 engages with the second recessed portion 22. The second rib 24 is still positioned in the second recessed portion 22 even in a state where the gear 13 is at the second rotational position and the relay member 15 is at the second position as illustrated in FIG. 6A. That is, the second rib 24 still engages with the second recessed portion 22 even in a state where the gear 13 is at the second rotational position and the relay member 15 is at the second position as illustrated in FIG. 6A. Incidentally, in this instance, a distance between the tip end 24A of the second rib 24 and the inner surface 22A of the second recessed portion 22 is smaller than a distance between the tip end 24A of the second rib 24 and the inner surface 22A of the second recessed portion 22 in a situation where the relay member 15 is at the first position.

Incidentally, the third rib 28 is engageable with the additional recessed portion (not illustrated) in the tubular member 14. Further, the third rib 28 is positioned at a diametrically opposite side of the second rib 24 with respect to the hole 15C. The third rib 28 has a structure and a function the same as those of the second rib 24, and therefore, detailed description as to the third rib 28 will be omitted.

2.5(2) Protrusion 25

Figure 5A:
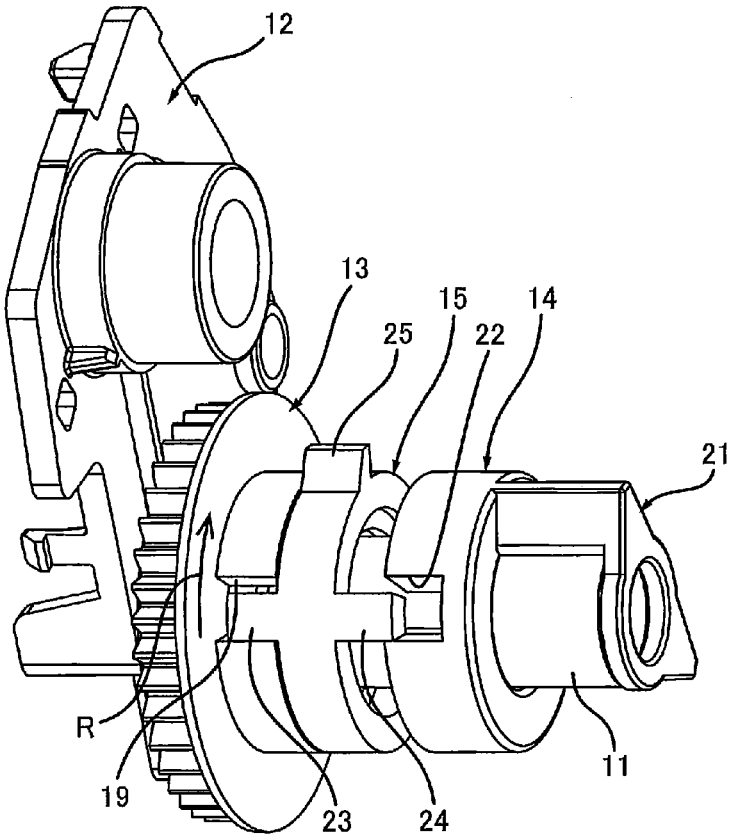
FIG. 5A is a partial perspective view of the developing cartridge according to the embodiment for description of a protrusion of the relay member, and illustrating a state in which the gear is at its first rotational position and the relay member is at its first position.
Figure 6A:
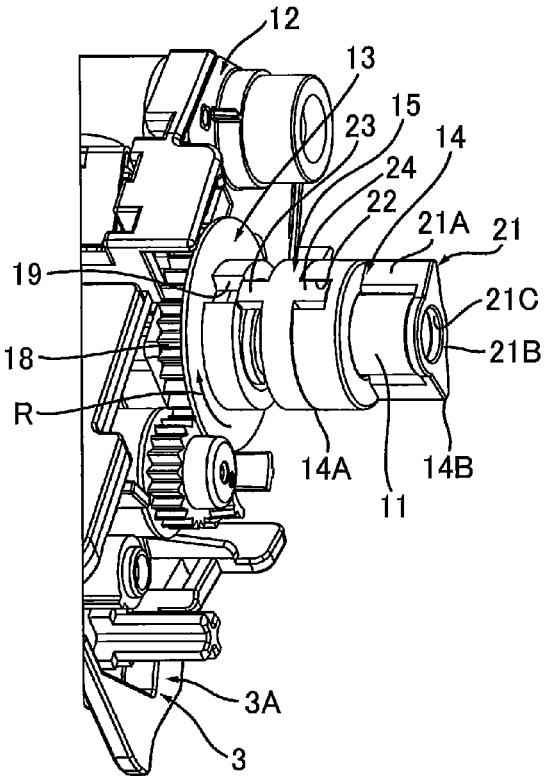
FIG. 6A is a view for description of the movement of the relay member subsequent to the state illustrated in FIG. 4A and illustrating a state in which the gear is at its second rotational position and the relay member is at its second position.
Figure 6B:
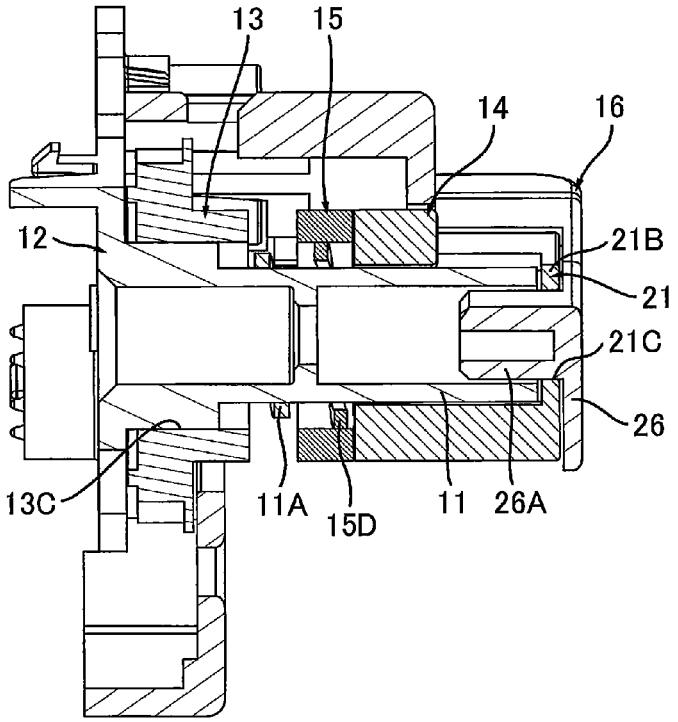
FIG. 6B is a cross-sectional view of FIG. 6A taken along the plane containing the first axis.

As illustrated in FIG. 5A, the relay member 15 further includes a protrusion 25. The protrusion 25 protrudes radially outwardly from an outer peripheral surface of the relay member 15. The protrusion 25 is positioned between the first rib 23 and the second rib 24 in the axial direction. As illustrated in FIG. 7B the protrusion 25 faces a protrusion 27 (described later) of the gear cover 16 in the rotational direction R of the gear 13 in a state where the relay member 15 is at the second position.

2.6 Gear Cover 16

Figure 1:
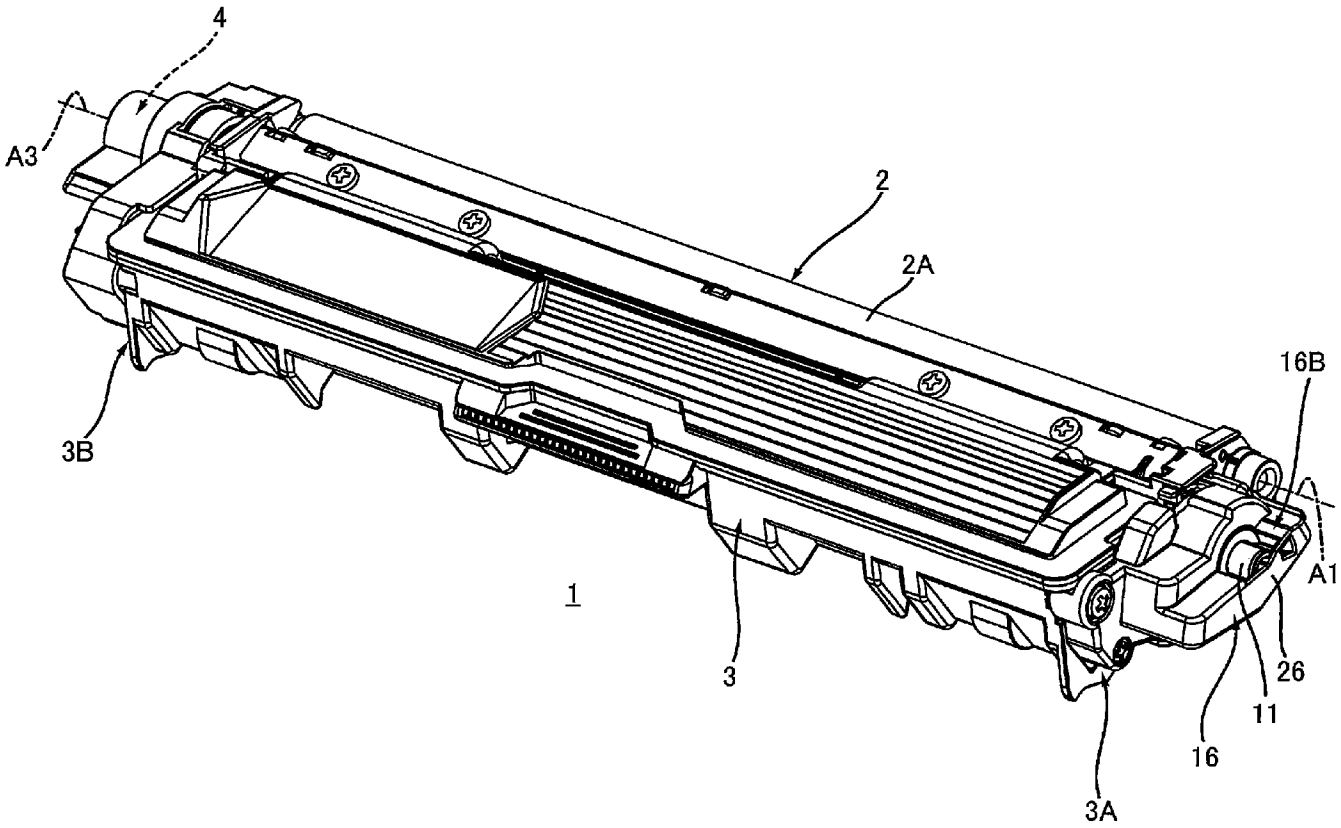
FIG. 1 is a perspective view of a developing cartridge according to one embodiment.

As illustrated in FIGS. 1 and 2, the gear cover 16 is attached to the one outer surface 3A of the casing 3. The gear cover 16 covers at least a portion of the gear 13 and the agitator gear 17.

Figure 5B:
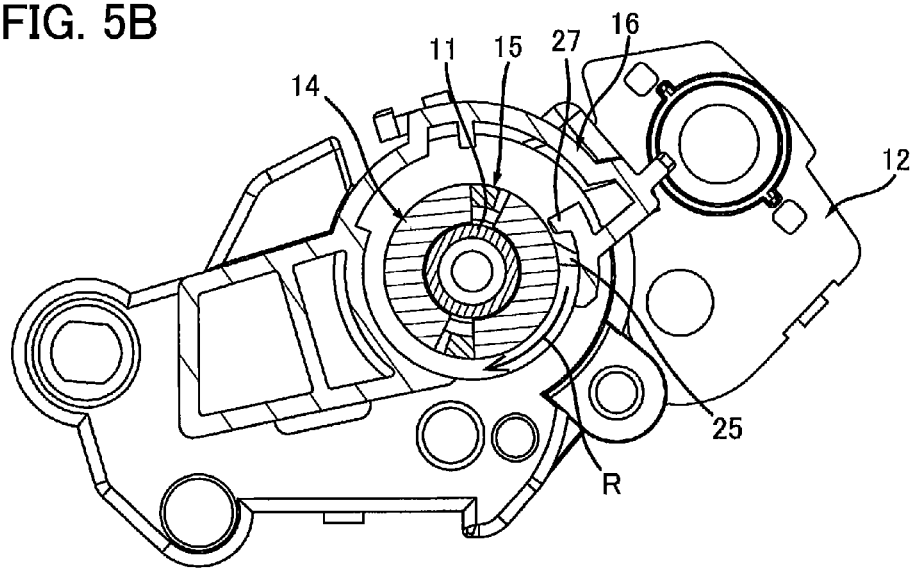
FIG. 5B is a view for description of the protrusion of the relay member along with FIG. 5A and illustrating positions of the protrusion of the relay member and a protrusion of a gear cover, and also illustrating the state in which the gear is at its first rotational position and the relay member is at its first position.

Further, the gear cover 16 has an insertion hole 16A and an opening 16B. The shaft 11 and the tubular member 14 are inserted into the insertion hole 16A. A portion of the shaft 11 and a portion of the tubular member 14 are exposed to an outside through the opening 16B. The protrusion 21 moves past the opening 16B during rotation of the gear 13 from the first rotational position to the second rotational position. Incidentally, in a state where the gear 13 is at the first rotational position, the protrusion 21 is positioned in the gear cover 16 and the shaft 11 is exposed to the outside through the opening 16B. Further, in a state where the gear 13 is at the second rotational position, the protrusion 21 is positioned in the gear cover 16 and the shaft 11 is exposed to the outside through the opening 16B. The gear cover 16 includes the side cover 26 and the protrusion 27 (FIG. 5B).

As illustrated in FIGS. 2 and 4B, the side cover 26 is configured to fix a position of the tubular member 14 in the axial direction in cooperation with the shaft 11. The side cover 26 is positioned opposite to the casing 3 with respect to the opening 16B in the axial direction. The side cover 26 faces the second cover portion 21B of the protrusion 21 in the axial direction. The side cover 26 extends in a direction crossing the axial direction. More specifically, the side cover 26 extends in a direction perpendicular to the axial direction.

The side cover 26 is brought into contact with the second cover portion 21B as a result of movement of the tubular member 14 in the axial direction away from the one outer surface 3A. Therefore, the side cover 26 prevents the tubular member 14 from further moving in the direction away from the one outer surface 3A. Incidentally, as described above, the second cover portion 21B is brought into contact with the shaft 11 as a result of movement of the tubular member 14 in the axial direction toward the one outer surface 3A. Accordingly, the shaft 11 prevents the tubular member 14 from approaching the one outer surface 3A. The side cover 26 includes the protrusion 26A. The protrusion 26A protrudes from the side cover 26 in the axial direction toward the one outer surface 3A. The protrusion 26A extends through the second cover portion 21B and is fitted with the tip end portion of the shaft 11.

Figure 7A:
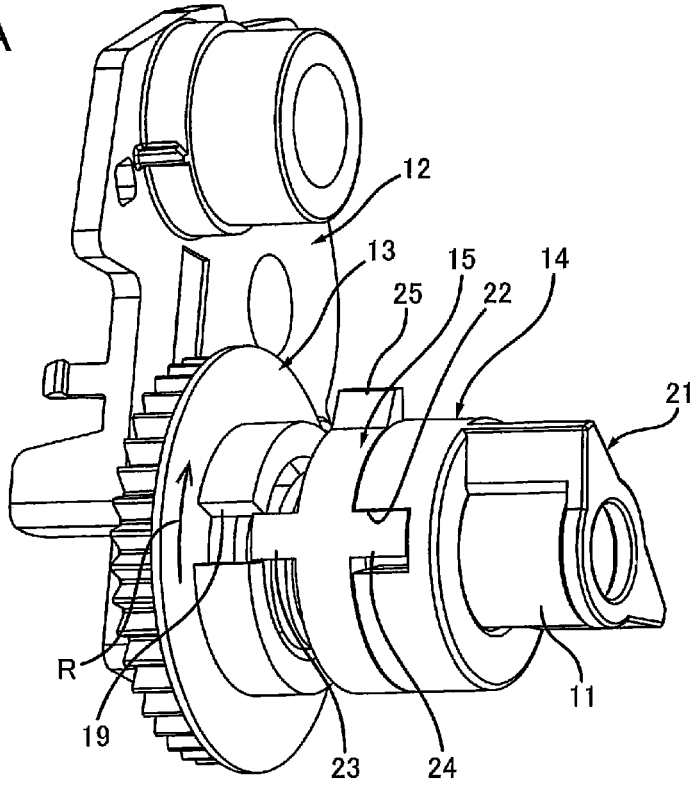
FIG. 7A is a partial perspective view of the developing cartridge according to the embodiment for description of the protrusion of the relay member along with FIG. 5A, and illustrating a state in which the gear is at its second rotational position and the relay member is at its second position.
Figure 7B:
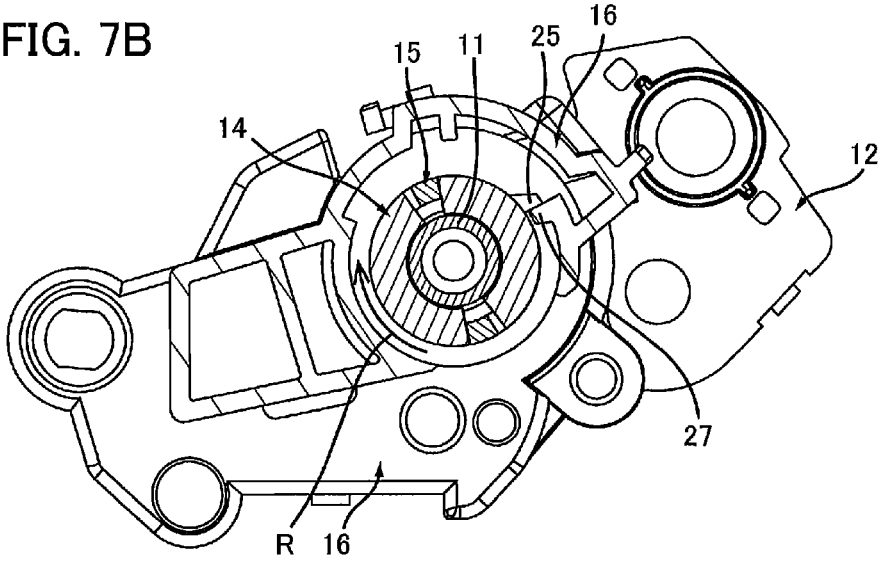
FIG. 7B is a view for description of the protrusion of the relay member along with FIG. 7A and illustrating positions of the protrusion of the relay member and the protrusion of the gear cover, and also illustrating the state in which the gear is at its second rotational position and the relay member is at its second position.

As illustrated in FIG. 7B, the relay member 15 prevents the gear 13 from rotating in the rotational direction R in a state where the relay member 15 is at the second position (FIG. 7A). The protrusion 27 is positioned inside the side cover 26 in the axial direction. The protrusion 27 faces the protrusion 25 of the relay member 15 in the rotational direction R of the gear 13 in a state where the relay member 15 is at the second position. Thus, the protrusion 25 is brought into contact with the protrusion 27 in the rotational direction R of the gear 13 by the rotation of the relay member 15 in the rotational direction R of the gear 13 in a state where the relay member 15 is at the second position. Rotation of the relay member 15 in the rotational direction R of the gear 13 is stopped by the abutment of the protrusion 25 with the protrusion 27.

2.7 Agitator Gear 17

As illustrated in FIG. 2, the agitator gear 17 is mounted to the agitator shaft and is positioned at the one outer surface 3A. The agitator gear 17 is rotatable along with the agitator. The agitator gear 17 is rotated by transmitting driving force received in the coupling 4 (FIG. 1) to the agitator shaft. Further, the agitator gear 17 is in meshing engagement with the gear 13. Thus, the gear 13 is rotated by the rotation of the agitator gear 17. That is, the gear 13 and the agitator gear 17 are rotated by the driving force received in the coupling 4.

3. Operation in Developing Cartridge

Operation in the developing cartridge 1 will be described with reference to FIGS. 4A and 6A.

Upon attachment of the developing cartridge 1 to the image forming apparatus, the electrode of the image forming apparatus is brought into contact with the shaft 11 (FIG. 1) through the opening 16B of the gear cover 16. Therefore, developing bias is applied to the shaft 11 from the electrode. In a state where the developing cartridge 1 is attached to the image forming apparatus and the coupling 4 receives the driving force from the image forming apparatus, the gear 13 starts rotating from the first rotational position (FIG. 4A) toward the second rotational position (FIG. 6A) by the driving force received by the coupling 4 (FIG. 1).

Then, as illustrated in FIG. 4A, the tubular member 14 is rotated along with the gear 13 and the relay member 15, since the relay member 15 is engaged with the gear 13 and the tubular member 14 in a state where the relay member 15 is at the first position. Therefore, the protrusion 21 moves about the shaft 11.

In this instance, the protrusion 21 moves past the opening 16B (FIG. 1) moving out of the gear cover 16, and then moves into the gear cover 16. The first cover portion 21A of the protrusion 21 passes through a portion between the electrode of the image forming apparatus and the shaft 11 in a case where the first cover portion 21A moves past the opening 16B. Accordingly, the electrode is separated from the shaft 11.

More specifically, in a case where the protrusion 21 moves past the opening 16B, the first cover portion 21A is brought into contact with the lever of the image forming apparatus to displace the lever, and the optical sensor detects the displacement of the lever. In this way, the image forming apparatus can receive information of the developing cartridge 1 on a basis of the displacement of the lever by way of the detection of the displacement of the lever by the optical sensor. For example, the image forming apparatus can determine whether or not the attached developing cartridge 1 is a new cartridge.

Further, in this instance, the relay member 15 moves from the first position toward the second position in the axial direction while rotating in the rotational direction R of the gear 13.

Then, the relay member 15 is brought to the second position as illustrated in FIG. 6A at a timing when the gear 13 is positioned at the second rotational position after the protrusion 21 is positioned into the gear cover 16.

As a result, rotation of the tubular member 14 is stopped upon disengagement of the tubular member 14 from the gear 13.

Incidentally, the gear 13 is still rotatable by the driving force received by the coupling 4, even after the tubular member 14 is stopped.

Further, the tubular member 14 does not rotate despite the fact that the gear 13 is rotated by the driving force received by the coupling 4 in a case where the developing cartridge 1 is attached to the image forming apparatus, if the relay member 15 is already positioned at the second position.

The electrode of the image forming apparatus is brought into contact with the shaft 11, and the developing bias is supplied from the electrode to the shaft 11 in a state where the protrusion 21 is positioned in the gear cover 16 and the rotation of the tubular member 14 is stopped.

On the other hand, the electrode of the image forming apparatus is not separated from the shaft 11 at a timing when the developing cartridge 1 is attached to the image forming apparatus, if the relay member 15 has already been positioned at the second position where rotation of the tubular member 14 does not occur. In other words, the optical sensor does not detect the displacement of the lever. The image forming apparatus determines that the developing cartridge 1 is a used cartridge if the image forming apparatus determines that the optical sensor does not detect the displacement of the lever.

Incidentally, information on the developing cartridge 1 is such information indicative of whether the developing cartridge 1 is a new cartridge or used cartridge. Further, the image forming apparatus may specify the number of sheets or number of dots printable by the developing cartridge 1 on a basis of number of times of detections to the displacement of the lever or detection timing of the displacement of the lever, those being detected by the optical sensor.

4. Function and Effect

In the developing cartridge 1, the tubular member 14 can rotate along with the gear 13 and the relay member 15 by the engagement of the relay member 15 with the gear 13 and the tubular member 14 in a state where the relay member 15 is at the first position as illustrated in FIG. 4A.

Further, the rotation of the relay member 15 and the tubular member 14 can be stopped by the disengagement of the relay member 15 from the gear 13 as a result of movement of the relay member 15 from the first position to the second position in accordance with the rotation of the gear 13 from the first rotational position to the second rotational position.

Consequently, rotation of the protrusion 21 can be stopped without disengagement of the gear 13 from the agitator gear 17 that transmits driving force to the gear 13.

5. Modifications 5.1 First Modification

Engagement between the gear 13 and the relay member 15 may be performed by a protrusion provided at the gear 13 and a recessed portion in the relay member 15. Further, engagement between the relay member 15 and the tubular member 14 may be performed by a protrusion provided at the tubular member 14 and a recessed portion formed in the relay member 15.

5.2 Second Modification

Instead of the plurality of gear teeth 18 provided at the gear 13, a friction portion is available. The friction portion is configured to rotate the gear 13 by frictional force generated by the frictional contact with the agitator gear 17. Any kind of friction portion is available as long as the friction portion can generate frictional force with the contact of the agitator gear 17. A rubber layer is one example of a friction portion.

5.3 Third Modification

Instead of the direct meshing engagement between the gear 13 and the agitator gear 17, the gear 13 may be positioned away from the agitator gear 17, and an endless belt may be mounted between the gear 13 and the agitator gear 17. In this case, the gear 13 can be rotated by the rotation of the agitator gear 17 through a circular motion of the endless belt. Further, instead of the gear 13 and the agitator gear 17, pulleys, which does not have teeth, are available.

5.4 Fourth Modification

At least one of the rib 11A of the shaft 11 and the rib 15D of the relay member 15 may be helical. For example, the rib 11A may be helical whereas the rib 15D may have a ring shape having a cutout portion entirely by entirely cutting out the ring-shape in the radial direction. Alternatively, the rib 15D may be helical, whereas the rib 11A may have a ring-shape having a cutout portion by entirely cutting out the ring-shape in the radial direction.

5.5 Fifth Modification

The relay member 15 may move toward the gear 13 in the axial direction during the rotation of the gear 13 from the first rotational position toward the second rotational position. In this case, the rib 11A of the shaft 11 and the rib 15D of the relay member 15 may include helical configuration for moving the relay member 15 toward the gear 13 in the axial direction during rotation of the relay member 15. Further, in this case, the engagement between the relay member 15 and the tubular member 14 is released in a state where the gear 13 is at the second rotational position.

5.6 Sixth Modification

A developing cartridge 1' according to a sixth modification will next be described with reference to FIGS. 8 through 12B wherein like parts and components are designated by the same reference numerals as those in the above-described embodiment.

Figure 8:
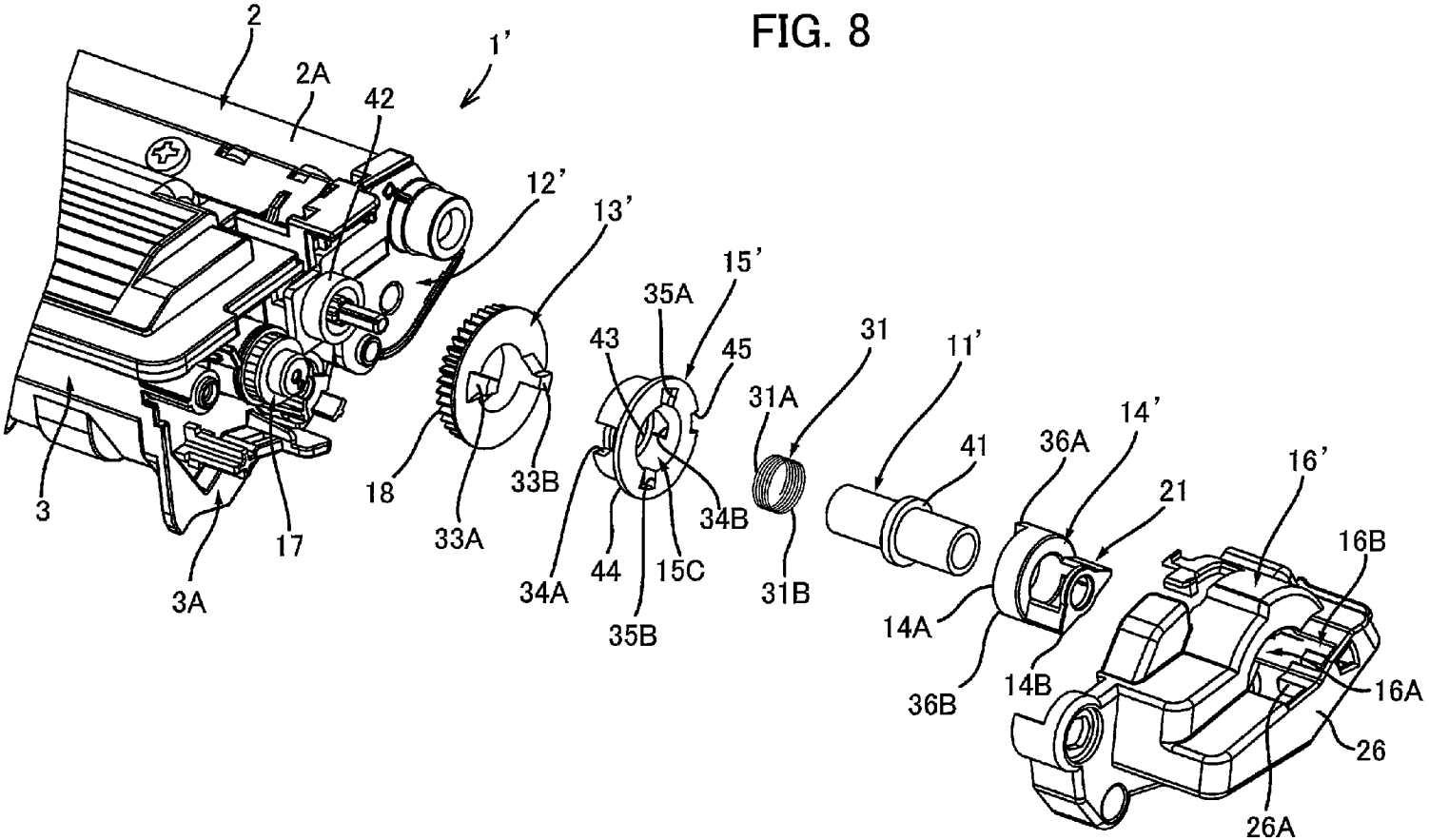
FIG. 8 is an exploded perspective view of a developing cartridge according to a sixth modification.
Figure 10A:
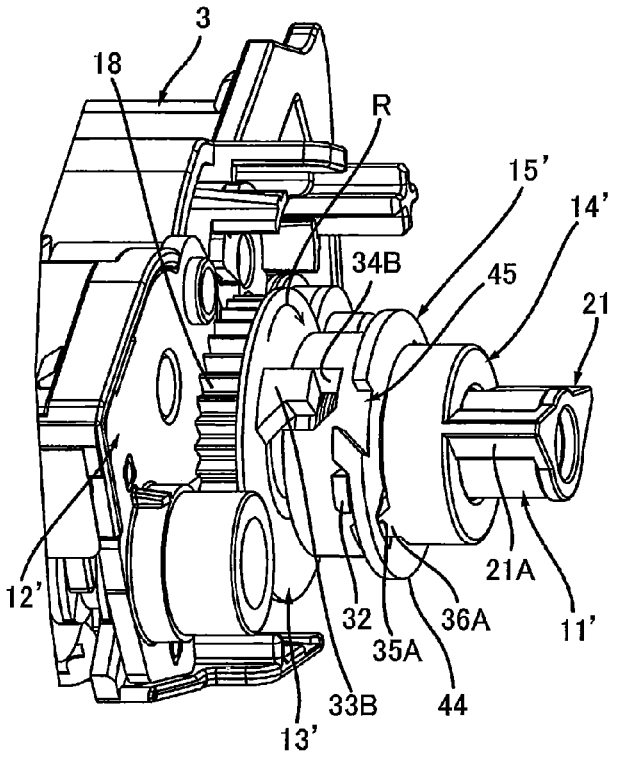
FIG. 10A is a partial perspective view of the developing cartridge according to the sixth modification for description of movement of a relay member, and illustrating a state in which a gear is at its first rotational position and the relay member is at its first position.

As illustrated in FIGS. 8 and 10A, a gear 13' includes a protrusion 33A and a protrusion 33B, and a relay member 15' includes recessed portion 34A, a recessed portion 34B, a recessed portion 35A, and a recessed portion 35B. Further, a tubular member 14' has a protrusion 36A and a protrusion 36B. Engagement between the gear 13' and the relay member 15' is achieved by fitting the protrusion 33A and the protrusion 33B with the recessed portion 34A and the recessed portion 34B, respectively. Further, engagement between the relay member 15' and the tubular member 14' is achieved by fitting the protrusion 36A and the protrusion 36B with the recessed portion 35A and a recessed portion 35B, respectively.

Figure 9:
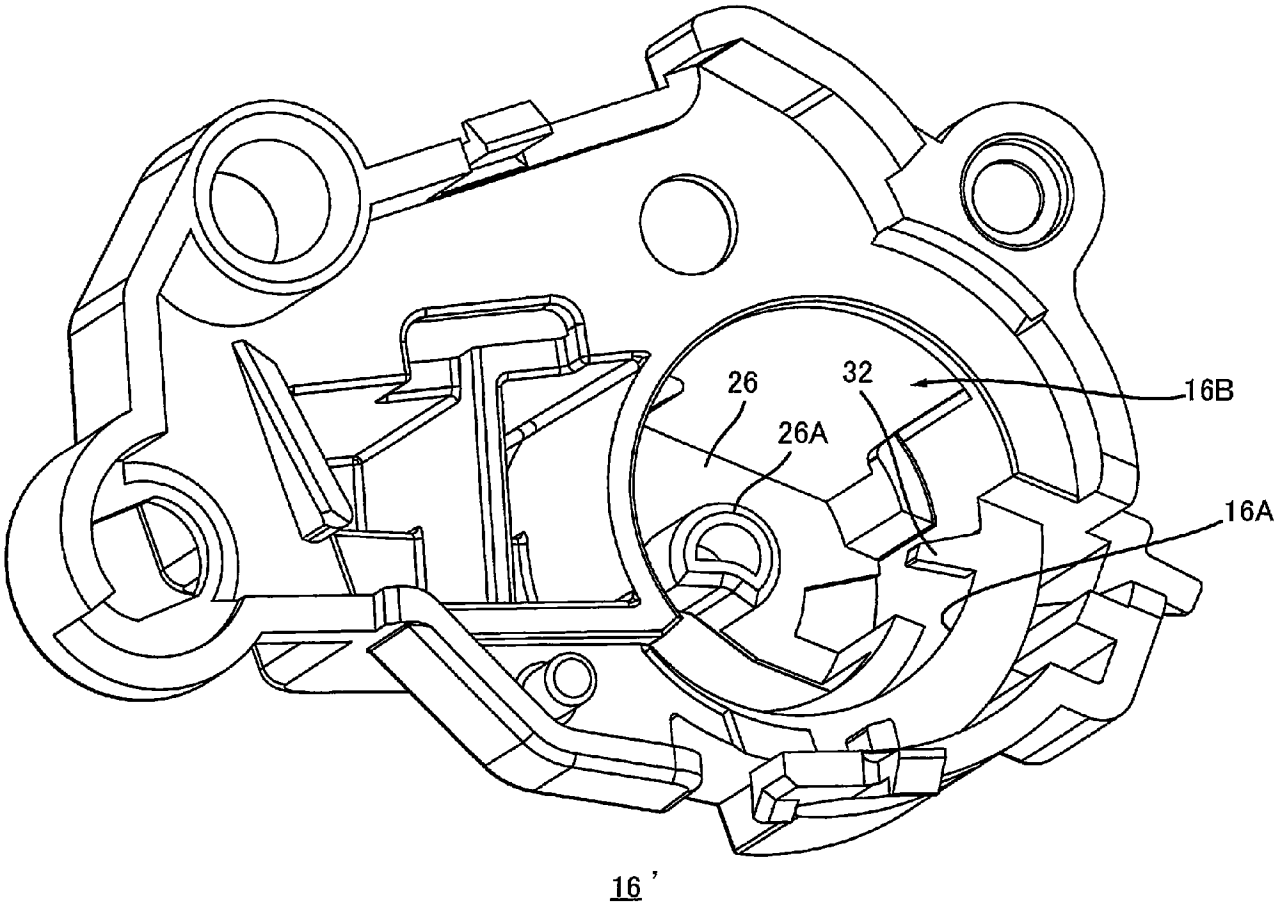
FIG. 9 is a perspective view of a gear cover in the developing cartridge according to the sixth modification.
Figure 10B:
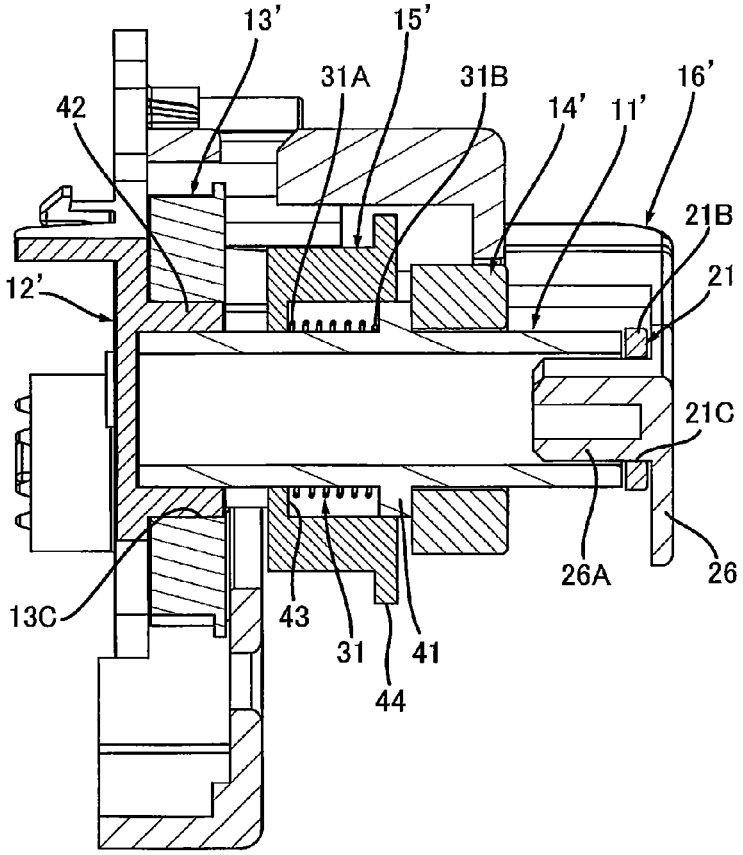
FIG. 10B is a cross-sectional view of FIG. 10A taken along a plane containing a first axis.
Figure 12A:
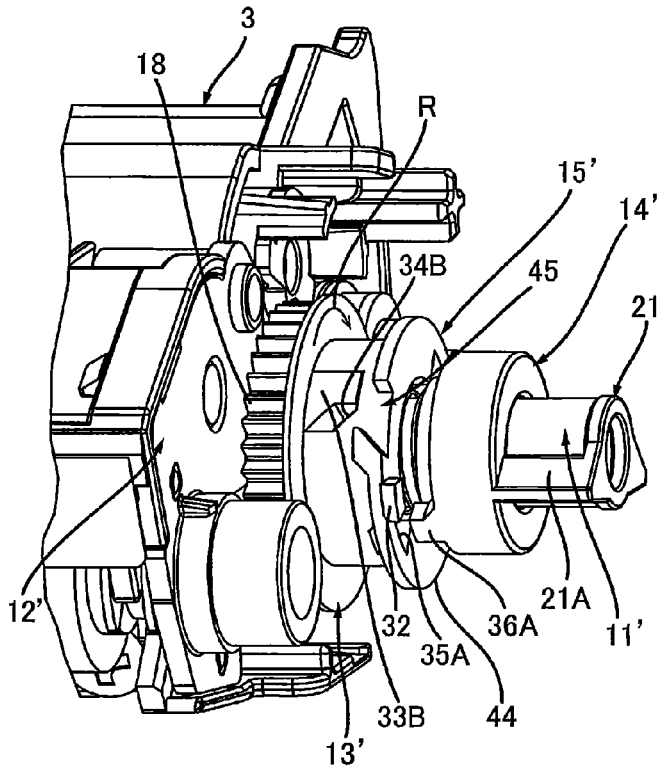
FIG. 12A is a partial perspective view of the developing cartridge according to the sixth modification for description of movement of the relay member subsequent to the state illustrated in FIG. 11B, and illustrating a state in which the relay member is at its second position and the gear is rotating.
Figure 12B:
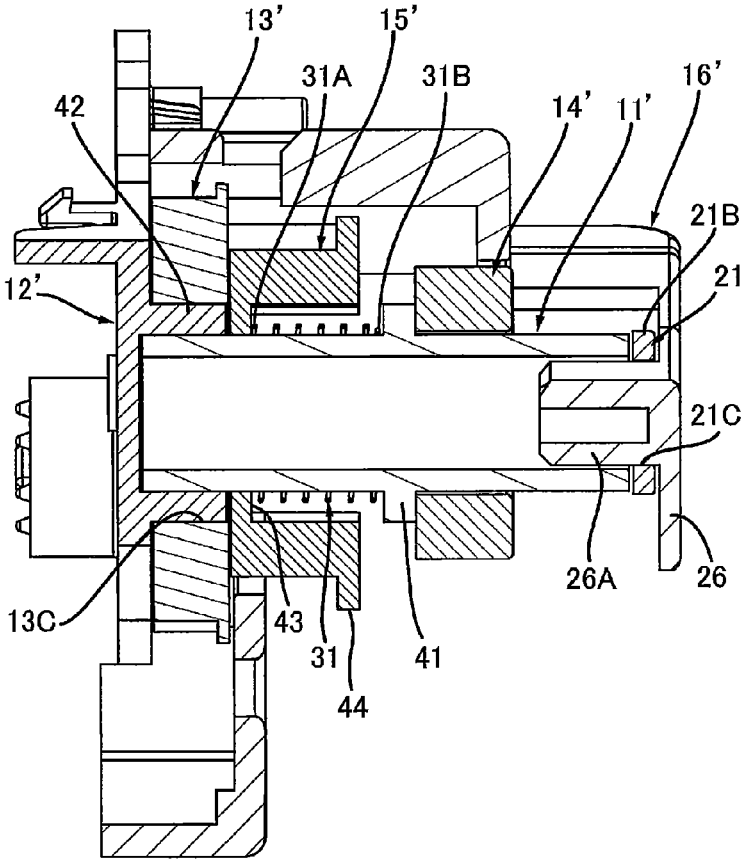
FIG. 12B is a cross-sectional view of FIG. 12A taken along a plane containing a first axis.

Further, as illustrated in FIGS. 8 and 9, an elastic member 31 is provided, and a gear cover 16' includes a protrusion 32. As illustrated in FIGS. 10B and 12B, the relay member 15' moves toward the gear 13' in the axial direction during rotation of the gear 13' from the first rotational position toward the second rotational position by the urging force of the elastic member 31 toward the gear 13'.

5.6(1) Elastic Member 31

As illustrated in FIGS. 8 and 10B, the elastic member 31 is positioned between the shaft 11' and the relay member 15'. More specifically, a rib 41 protrudes from an outer peripheral surface of the shaft 11' and extends in the rotational direction R of the gear 13'. According to the sixth embodiment, the shaft 11' is not integral with the bearing 12, but is attached to a bearing 12'. The bearing 12' includes a attaching portion 42 to which the shaft 11' is attached. The attaching portion 42 is hollow cylindrical extending in the axial direction. The shaft 11' is attached to the bearing 12' by attaching the shaft 11' to the attaching portion 42. The relay member 15' has a rib 43 protruding radially inward toward the shaft 11' from an inner peripheral surface of a hole 15C and extending in the rotational direction R of the gear 13'.

A compression coil spring is one example of the elastic member 31. However, any kind of elastic member is available as long as the elastic member can expand in the axial direction from an axially shrinking state by elastic restoration force. Sponge and rubber are also available. The elastic member 31 is positioned between the outer peripheral surface of the shaft 11' and the inner peripheral surface of the hole 15C. Further, the elastic member 31 is positioned between the rib 41 and the rib 43 in the axial direction. The elastic member 31 extends in the axial direction and has one end 31A and another end 31B in the axial direction. The elastic member 31B is positioned opposite to the gear 13' with respect to the elastic member 31A. The elastic member 31A is seated on the rib 43, and the elastic member 31B is seated on the rib 41.

The elastic member 31 provides a first state as illustrated in FIG. 10B having a first length in the axial direction, and provides a second state as illustrated in FIG. 12B having a second length in the axial direction greater than the first length. The elastic member 31 in its first state has a elastic force greater than that in the second state in the axial direction. That is, urging force of the elastic member 31 applied to the relay member 15' in the first state is greater than that in the second state.

As illustrated in FIG. 10B, the elastic member 31 is at the first state in a state where the relay member 15' is at the first position. That is, the elastic member 31 is configured to urge the relay member 15' toward the gear 13' while the relay member 15' is engages with the protrusion 32 (FIG. 10A). Therefore, the relay member 15' is urged toward the second position by the elastic member 31 in a state where the relay member 15' is at the first position. Further, as illustrated in FIG. 12B, the elastic member 31 is at the second state in a state where the relay member 15' is at the second position where the relay member 15' is positioned closer to the gear 13' in the axial direction than in the first phase. Incidentally, the elastic member 31 is configured to urge the relay member 15' toward the gear 13' in a state where the relay member 15' is at the second position so as to prevent the relay member 15' from moving from the second position toward the first position.

5.6(2) Protrusion 32

As illustrated in FIGS. 9 and 10A, the protrusion 32 protrudes from the gear cover 16 toward the relay member 15'. That is, the protrusion 32 extends toward the relay member 15'. More specifically, the protrusion 32 is provided at an open end of a insertion hole 16A. The protrusion 32 protrudes from the open end of the insertion hole 16A radially inwardly of the insertion hole 16A. In other words, the protrusion 32 protrudes from the open end of the insertion hole 16A toward an outer surface of the relay member 15' in the radial direction of the relay member 15'. The protrusion 32 is integral with the gear cover 16', or may be attached to the gear cover 16' as a separate component.

Figure 11A:
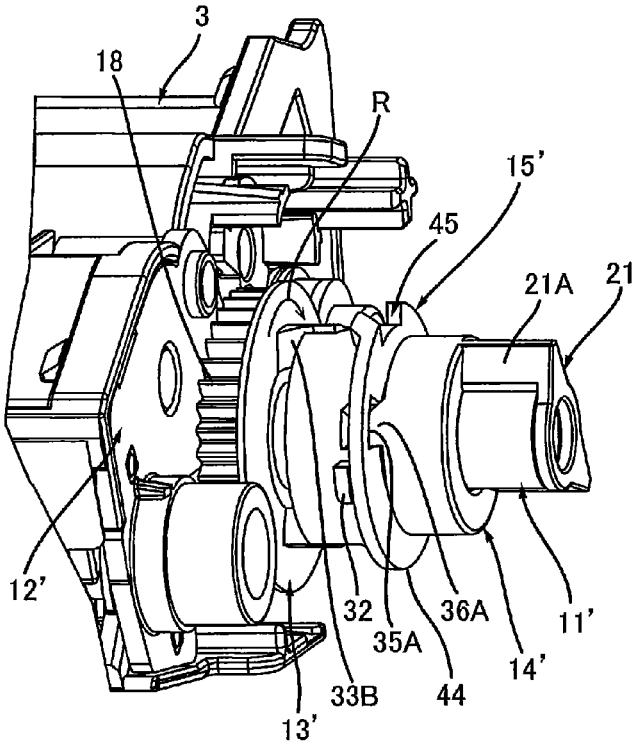
FIG. 11A is a partial perspective view of the developing cartridge according to the sixth modification for description of movement of the relay member subsequent to the state illustrated in FIG. 10A, and illustrating a state in which the gear is positioned between the first rotational position and a second rotational position, and the relay member is at its first position.

The protrusion 32 is configured to engage the relay member 15' in a state where the relay member 15' is at the first position. More specifically, the relay member 15' includes a rib 44 and has a recessed portion 45. The rib 44 protrudes from the outer surface of the relay member 15 and extends in the rotational direction R of the gear 13'. The rib 44 is lost at the recessed portion 45. The recessed portion 45 is positioned at a portion of the relay member 15' in the rotational direction R of the gear 13'. More specifically, the recessed portion 45 is recessed from the outer surface of the rib 44 radially inward toward the hole 15C (FIG. 8). The protrusion 32 of the gear cover 16' is positioned between the rib 44 and the gear 13' in the axial direction, in a state where the relay member 15' is at the first position. The protrusion 32 is in contact with the rib 44 in a state where the relay member 15' is at the first position to prevent the relay member 15' from moving toward the gear 13'. Accordingly, the relay member 15' can be positioned at the first position while engaging the protrusion 32 in a state where the gear 13' is at the first rotational position. Incidentally, contact between the protrusion 32 and the rib 44 are maintained during rotation of the gear 13' from the first rotational position to the second rotational position as illustrated in FIG. 11A. As a result, the first position of the relay member 15' is maintained during rotation of the gear 13' from the first rotational position to the second rotational position.

Figure 11B:
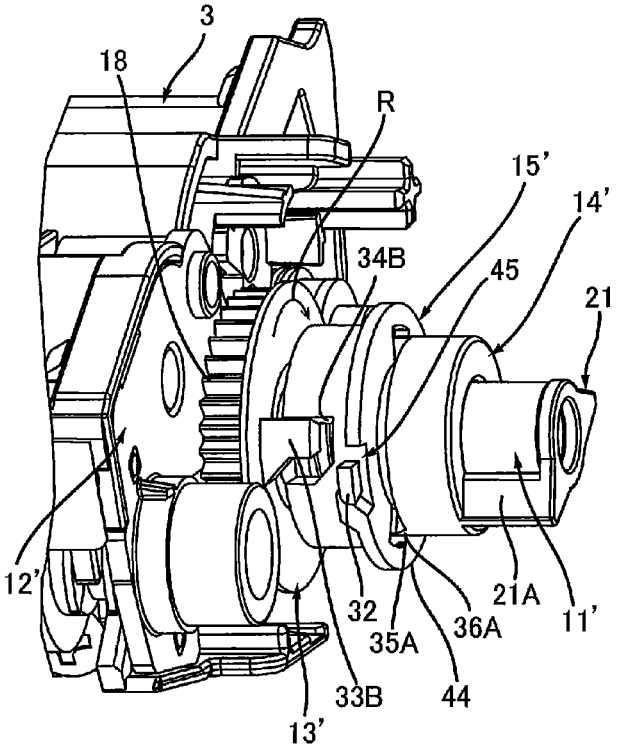
FIG. 11B is a partial perspective view of the developing cartridge according to the sixth modification for description of movement of the relay member subsequent to the state illustrated in FIG. 11A, and illustrating a state in which the gear is at its second rotational position, and the relay member is moving on its way to a second position from the first position.

Then, engagement between the protrusion 32 and the relay member 15' is released in a state where the gear 13' is positioned to the second rotational position as illustrated in FIG. 11B. More specifically, the protrusion 32 is brought into alignment with the recessed portion 45 in the axial direction in a state where the gear 13' is at the second rotational position. Therefore, contact between the protrusion 32 and the rib 44 is released, so that the engagement between the protrusion 32 and the relay member 15' is released. Thus, the relay member 15' is movable from the first position toward the second position, and the relay member 15' is moved from the first position to the second position by the urging force of the elastic member 31 (FIG. 10B and FIG. 12B). Consequently, the relay member 15' is positioned at the second position while being disengaged from the protrusion 32 in a state where the gear 13 is at the second rotational position as illustrated in FIGS. 12A and 12B.

In a state where the relay member 15' is positioned at the second position, engagement between the relay member 15' and the tubular member 14' is released. Therefore, the relay member 15' rotates along with the gear 13', while the tubular member 14' is stopped after the relay member 15' is positioned at the second position. Incidentally, the protrusion 32 is positioned between the rib 44 and the tubular member 14' in the axial direction in a state where the relay member 15' is positioned at the second position. Therefore, the protrusion 32 does not prevent the relay member 15' from rotating after the relay member 15' moves to the second position.

5.6(3) Function and Effect

The sixth modification provides function and effect the same as those of the above-described embodiment.

While the description has been made in detail with reference to specific embodiment and modifications, it would be apparent to those skilled in the art that various changes and modifications may be made therein without departing from the spirit and scope of the above described embodiment and modifications.

What is claimed is:

1. A developing cartridge comprising:

a casing configured to accommodate therein developing agent, and the casing having an outer surface;

a shaft, positioned at the outer surface, the shaft extending in an axial direction, and the shaft including a peripheral surface;

a gear rotatable about a first axis extending in the axial direction from a first rotational position to a second rotational position;

a tubular member rotatable about an axis extending in the axial direction, the tubular member extending in the axial direction, the tubular member including a protrusion rotatable with the tubular member, the protrusion extending along a portion of the peripheral surface of the shaft; and a relay member positioned between the gear and the tubular member in the axial direction, the relay member being movable in the axial direction during rotation of the gear from the first rotational position to the second rotational position, wherein, in a case where the gear is at the first rotational position, the tubular member is rotatable with the relay member and the gear in a state where the gear and the relay member engage with each other and the relay member and the tubular member engage with each other, and wherein, in a case where the gear is at the second rotational position, an engagement between the gear and the relay member or an engagement between the relay member and the tubular member is released.

2. The developing cartridge according to claim 1, wherein the relay member is movable in a direction away from the gear during rotation of the gear from the first rotational position to the second rotational position, and wherein an engagement between the gear and the relay member is released in a case where the gear is at the second rotational position.

3. The developing cartridge according to claim 1, wherein the relay member has a tubular shape which extends in the axial direction, and has one end portion and another end portion in the axial direction, the another end portion being positioned farther from the outer surface than the one end portion is from the outer surface in the axial direction, the relay member having a first rib protruding from the one end portion of the tubular shape toward the gear;

wherein the gear has one end portion and another end portion in the axial direction, the another end portion of the gear being positioned farther from the outer surface than the one end portion of the gear is from the outer surface, the gear having a first recessed portion recessed from the another end portion of the gear toward the one end portion of the gear, the first rib being configured to engage with the first recessed portion;

wherein, in a case where the gear is at the first rotational position, the tubular member is rotatable with the relay member and the gear in a state where the first rib engages with the first recessed portion; and wherein, in a case where the gear is at the second rotational position, an engagement between the first rib and the first recessed portion is released.

4. The developing cartridge according to claim 1, wherein the relay member is a tubular shape which extends in the axial direction, and having one end portion and another end portion in the axial direction, the another end portion being positioned farther from the outer surface than the one end portion is from the outer surface in the axial direction, the relay member further having a second rib protruding from the another end portion of the relay member toward the tubular member;

wherein the tubular member has one end portion and another end portion in the axial direction, the another end portion of the tubular member being positioned farther from the outer surface than the one end portion of the tubular member is from the outer surface in the axial direction, the protrusion being positioned at the another end portion of the tubular member, the tubular member having a second recessed portion recessed from the one end portion of the tubular member toward the another end portion of the tubular member, wherein the tubular member is rotatable with the relay member in a state where the second rib being configured to engage with the second recessed portion.

5. The developing cartridge according to claim 1, wherein the relay member has a through-hole through which the shaft is inserted, at least one of a peripheral surface of the shaft and an inner peripheral surface of the through-hole having helical configuration, and wherein the relay member is rotatable about the shaft and movable in the axial direction along the helical configuration.

6. The developing cartridge according to claim 5, wherein remaining one of the peripheral surface of the shaft and the inner peripheral surface of the through-hole includes a rib configured to engage the helical construction and move the relay member in the axial direction along the helical configuration.

7. The developing cartridge according to claim 1, wherein the relay member is movable toward the gear during rotation of the gear from the first rotational position to the second rotational position, and wherein, in a case where the gear is at the second rotational position, an engagement between the relay member and the tubular member is released.

8. The developing cartridge according to claim 7, further comprising;

a protruding portion protruding toward the relay member; and an elastic member positioned between the shaft and the relay member, the elastic member configured to urge the relay member toward the gear in a state where the relay member engages with the protruding portion, the elastic member having a first state in which a length of the elastic member in the axial direction is a first length and a second state in which a length of the elastic member in the axial direction is a second length being greater than the first length, wherein the elastic member is in the first state in a case where the relay member is at the first position, wherein the elastic member is in the second state in a case where the relay member is at the second position being closer to the gear than the first position is to the gear, wherein, in a case where the gear is at the first rotational position, the relay member is at the first position in a state where the relay member engages with the protruding portion, and wherein, in a case where the gear is at the second rotational position, the relay member is at the second position in a state where an engagement between the relay member and the protruding portion is released.

9. The developing cartridge according to claim 8, further comprising a gear cover covering the gear, and wherein the protruding portion protrudes from the gear cover toward the relay member.

10. The developing cartridge according to claim 8, wherein the elastic member is a coil spring.

* * * * *